US005564913A

United States Patent [19]

Lee

[11] Patent Number: 5,564,913

[45] Date of Patent: Oct. 15, 1996

[54] AIR PRESSURE PUMP WITH REVERSIBLE POWER CYLINDER

[76] Inventor: Ta-Shun Lee, 23, Chyan-Ban, An-Cheng-Li, Ma-Dou-Cheng, Tainan Hsien, Taiwan

[21] Appl. No.: 511,442

[22] Filed: Aug. 4, 1995

[51] Int. Cl.[6] ..... F04B 17/00

[52] U.S. Cl. ..... 417/397; 417/403

[58] Field of Search ..... 417/397, 403, 417/404

[56] References Cited

U.S. PATENT DOCUMENTS 3,582,238 6/1971 Devine ..... 417/397
5,092,746 3/1992 Henke ..... 417/403
5,244,361 9/1993 Solomon ..... 417/403
5,328,339 7/1994 Jong ..... 417/403

*Primary Examiner*—Richard E. Gluck
*Attorney, Agent, or Firm*—Larson and Taylor

[57] ABSTRACT

An air pressure pump with reversible power cylinder comprises a cylinder, a left cap and a right cap disposed at two sides of the cylinder. A piston passes through the cylinder. An air inlet pipe and two air outlet pipes connect the left cap. A collar has five lead holes. The collar surrounds a movable sleeve. Two ring grooves are formed on the movable sleeve. Two passages are disposed on the left cap. The right cap has a central hole to receive a pump. The pump has a central hole to support a rod. A Second valve seat is disposed at the bottom of the pump. A through hole is in the second valve seat.

2 Claims, 8 Drawing Sheets

AIR PRESSURE PUMP WITH REVERSIBLE POWER CYLINDER

BACKGROUND OF THE INVENTION

The invention relates to an air pressure pump. More particularly, the invention relates to an air pressure pump with a power cylinder.

U.S. Pat. No. 5,328,339 discloses an air pressure pump. The pump has an air cylinder, a piston in the air cylinder to move upward or downward, an upper cylinder cap and a lower cylinder cap, and other essential elements. However, the structure of the cited reference is relatively complex.

SUMMARY OF THE INVENTION

An object of the invention is to provide an air pressure pump with a reversible power cylinder which has a relatively simple structure.

Another object of the invention is to provide an air pressure pump with a reversible power cylinder which has a single cylinder to operate as both a high pressure oil cylinder and a low pressure oil cylinder.

Yet another object of the invention is to provide an air pressure pump with a reversible power cylinder which can operate very fast.

Accordingly, an air pressure pump comprises a cylinder, a left cap and a right cap disposed at two sides of the cylinder. A piston passes through the cylinder. An air inlet pipe and a first and second air outlet pipes connect the left cap. A collar has a first, a second, a third, a fourth and a fifth lead holes. The spaced lead holes communicate with the air inlet pipe and the first and second air outlet pipes. The collar surrounds a movable sleeve. First and second ring grooves are formed on the end periphery of the movable sleeve. A first passage and a second passage are disposed on the left cap. The first passage communicates with the second lead hole. The second passage communicates with the fourth lead hole. One end of the first passage communicates with the right cap. One end of the second passage communicates with the cylinder. The right cap has a third passage to communicate with the first passage and to provide air into the cylinder. The right cap has a central hole to receive a pump. The pump has a central hole to support a rod. A valve seat is disposed at the bottom of the pump. The piston connects the rod which extends in the movable sleeve with an end of the rod. One end of a first elastic element which surrounds the end portion of the rod is restricted by a cover, and the other end of the first elastic element presses the movable sleeve. A second valve seat connects the pump. A through hole in the second valve seat communicates with the pump. The through hole communicates with a liquid inlet hole and a liquid outlet hole. First and second balls restrict the flow of liquid at the liquid inlet hole and the liquid outlet hole in one direction, respectively. A steel ball and an elastic element are disposed on a recess at the periphery of the movable sleeve. First and second ring grooves are formed on the right portion of the movable sleeve.

Accordingly, a reversible power cylinder comprises a cylinder, a left cap, a right cap, a first and second valve seats, and a piston. The left cap covers the left opening of the cylinder. The right cap covers the right opening of the cylinder. A movable sleeve which is disposed in the cylinder is surrounded by a collar. The first, the second, the third, the fourth and the fifth lead holes are spacedly formed on the collar to communicate with an air inlet pipe and the first and second air outlet pipes. A first and second ring grooves are formed on the periphery of the movable sleeve. A steel ball and an elastic element are disposed in the recess on the periphery of the collar. A first passage and a second passage are disposed on the left cap. The first passage communicates with the second lead hole and the third passage which is disposed in the right cap. The second passage communicates with the fourth lead hole and the cylinder. The second valve seat and the left cap are connected by a rod which is moved reciprocately in the first inner passage of the movable sleeve. The right cap has third passage to communicate with the first passage. A central hole is formed on the right cap to receive a pump. The pump and the second valve seat are connected by a connection pipe. The piston is disposed in the cylinder. One portion of the rod is in the inner passage. The first elastic element is disposed inside an end portion of the movable sleeve. The second elastic element is disposed between the piston and the movable sleeve. The first valve seat connects the pump. An oil passage is disposed in the first valve seat and the pump. An opening is formed in the second valve seat to communicate with the first inner passage. A filter layer is disposed in the bottom of the liquid inlet pipe.

DETAILED DESCRIPTION OF THE INVENTION

Figure 1:
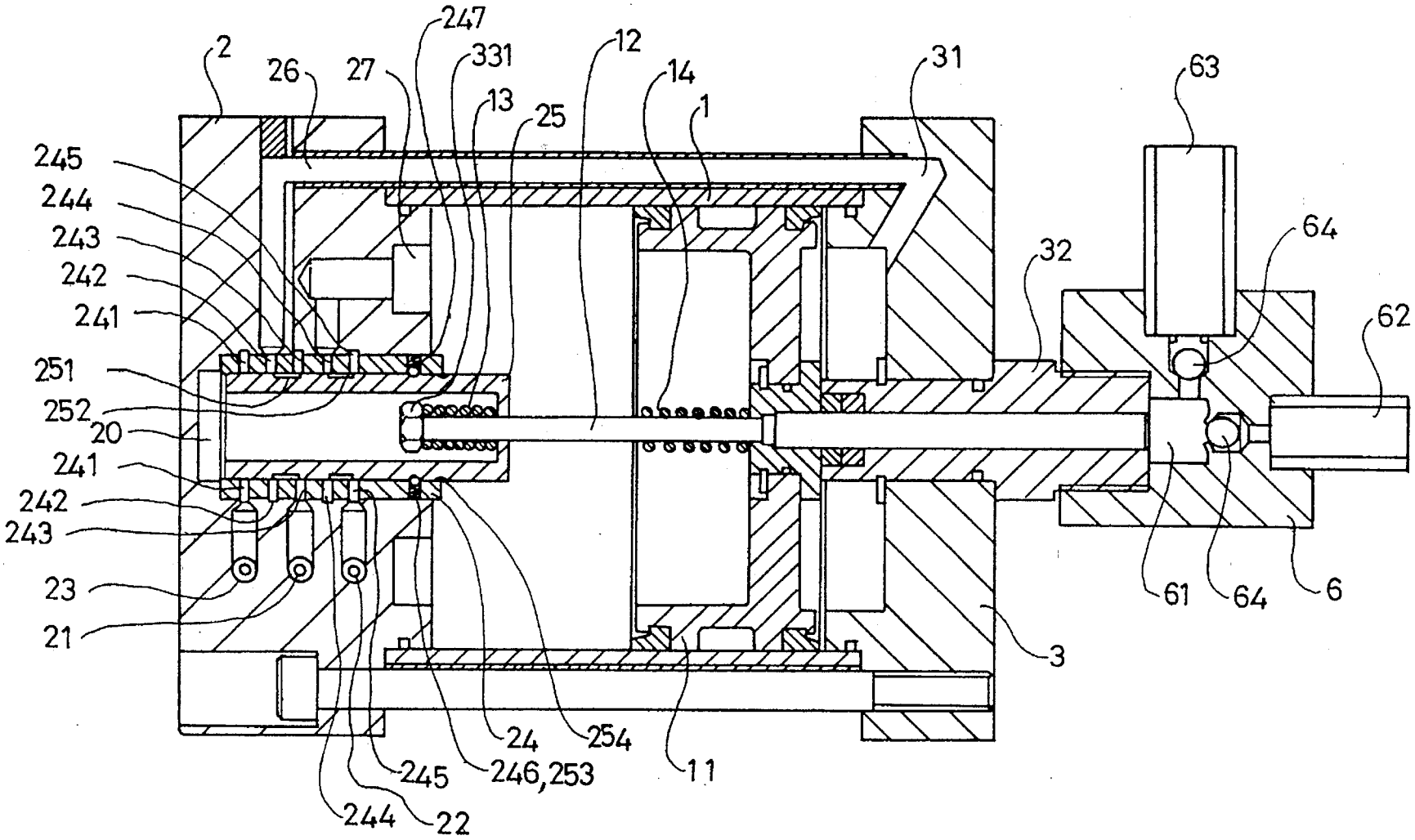
FIG. 1 is a cross-sectional view of a pump in accordance with the invention.
Figure 2:
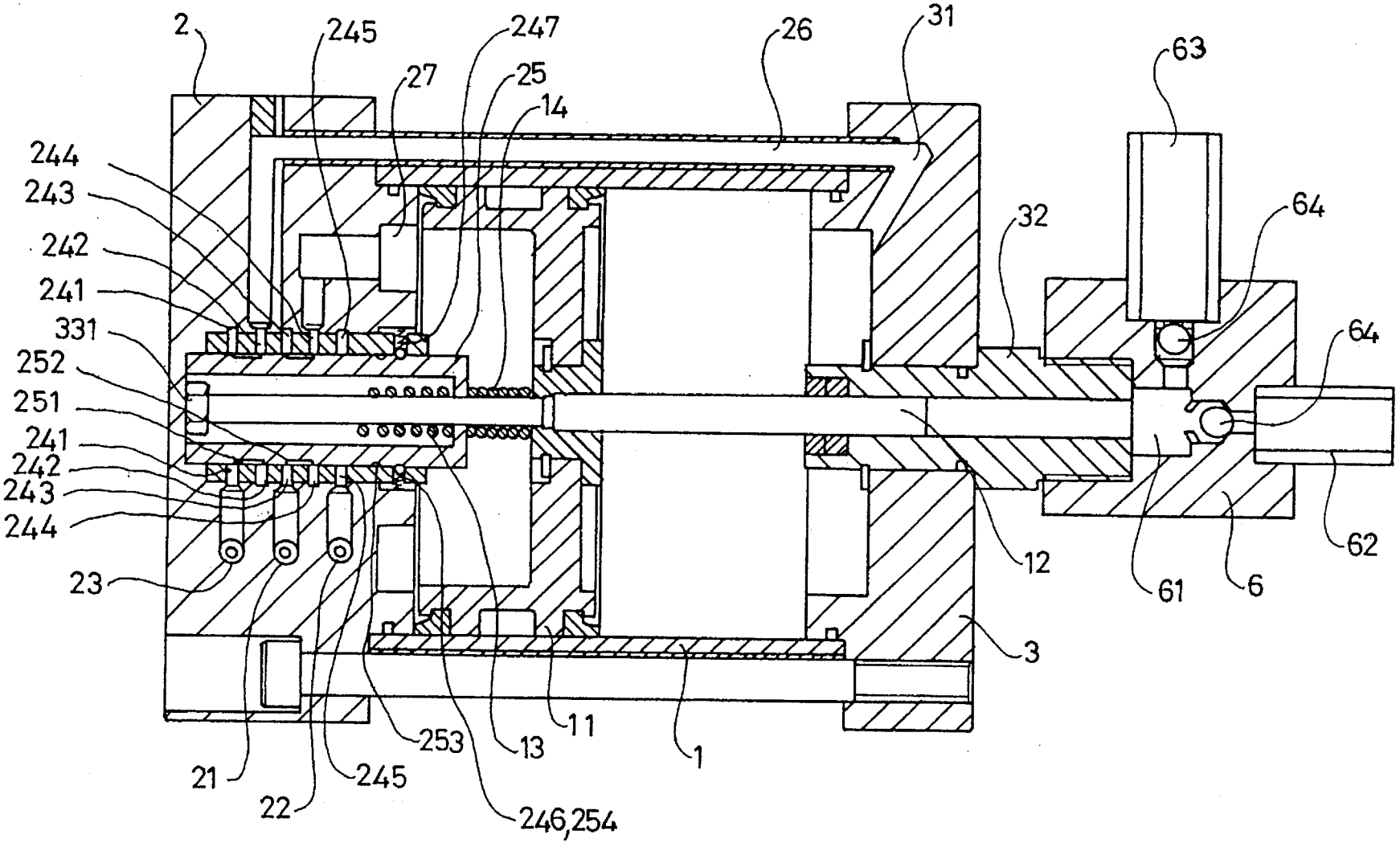
FIG. 2 illustrates a cross-sectional view of a pump in operation.

FIGS. 1 and 2 illustrate an air pressure pump of the invention. The air pressure pump has a cylinder 1, a left cap 2 and a right cap 3 disposed at the two sides of the cylinder 1. A piston 11 passes through the cylinder 1. An air inlet pipe 21 and two air outlet pipes 22 and 23 connect the left cap 2. A collar 24 has lead holes 241, 242, 243, 244 and 245. A hole 20 is formed on the collar 24. The spaced lead holes 241 to 245 communicate with the air inlet pipe 21 and the air outlet pipes 22 and 23. The collar 24 surrounds a movable sleeve 25. A first ring groove 251 and a second ring groove 252 are formed on the and periphery of the movable sleeve 25. A first passage 26 and a second passage 27 are disposed on the left cap 2. The first passage 26 communicates with the second lead hole 242. The second passage 27 communicates with the fourth lead hole 244. One end of the first passage 26 communicates with the right cap 3. One end of the second passage 27 communicates with the cylinder 1.

The right cap 3 has a third passage 31 to communicate with the first passage 26 and to provide air into the cylinder 1. Thus the piston 11 moves leftward. When the piston 11 moves rightward, the air flows out in the reverse direction. The right cap 3 has a central hole to receive a pump 32. The pump 32 has a central hole to support a rod 12. A valve seat 6 is disposed at the bottom of the pump 32.

The piston 11 is moved rightward by the pressure of the air from the second passage 27. The piston 11 is moved leftward by the pressure of the air from the third passage 31. The piston 11 connects the rod 12 which extends in the movable sleeve 25 with one end. One end of a first elastic element 13 which surrounds the end portion of the rod 12 is restricted by a cover 331, and the other end of the first elastic element 13 presses the movable sleeve 25 to move rightward. The motion of the movable sleeve 25 matches the motion of the rod 12. The periphery of the rod 12 between the piston 11 and the movable sleeve 25 is surrounded by a second elastic element 14 which presses the movable sleeve 25 to move leftward.

A valve seat 6 is connected to the pump 32. A hole 61 in the valve seat 6 communicates with the pump 32. Thus the hole 61 communicates with the liquid inlet hole 62 and the liquid outlet hole 63. First and second balls 64 restrict the flow of liquid at the liquid inlet hole 62 and the liquid outlet hole 63 in one direction, respectively. A steel ball 246 and an elastic element 247 are disposed on the recess at the periphery of the movable sleeve 25. Two ring grooves 253 and 254 are formed on the right portion of the movable sleeve 25.

Figure 3:
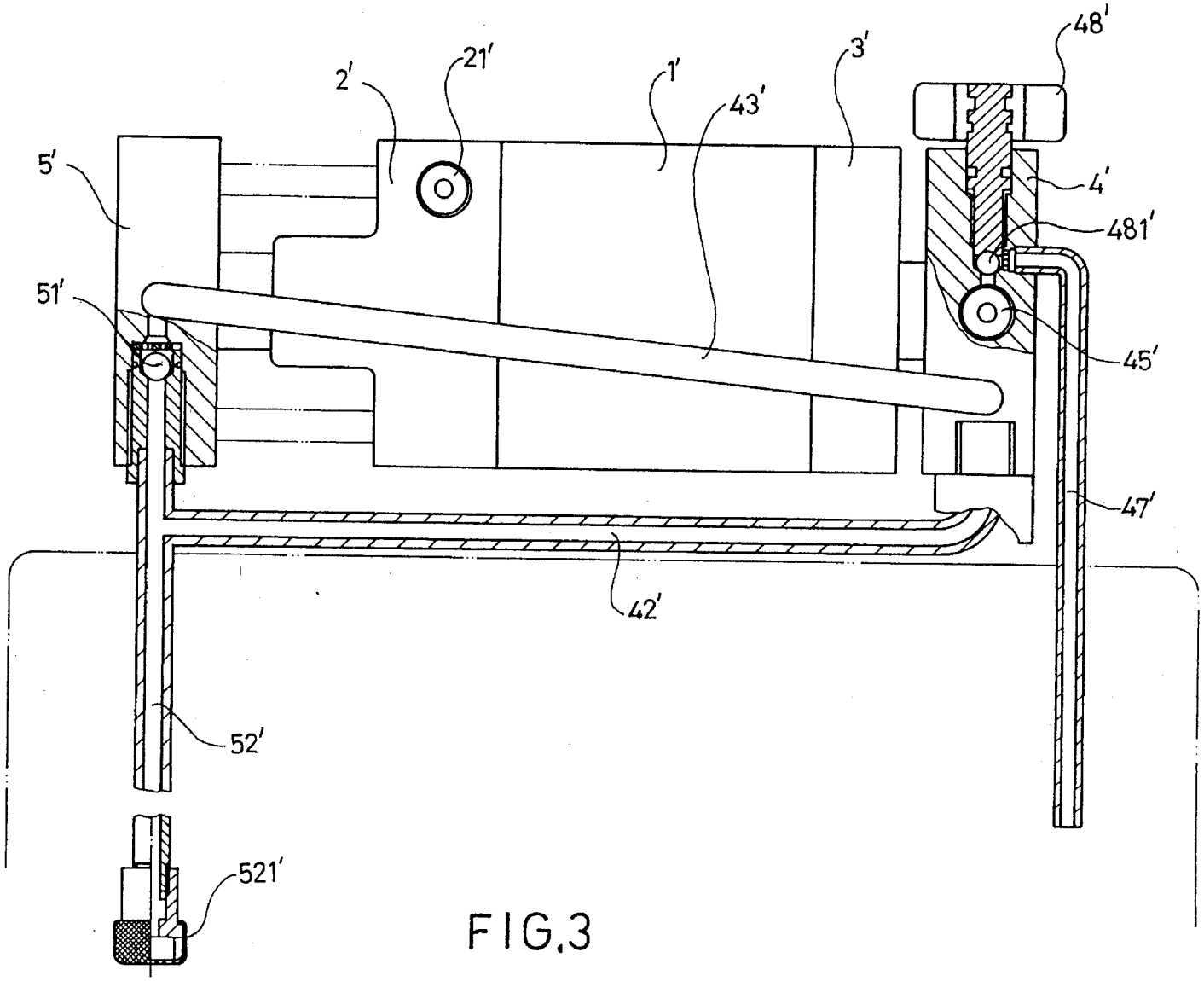
FIG. 3 is a front cross-sectional view of a power cylinder in accordance with the invention.
Figure 4:
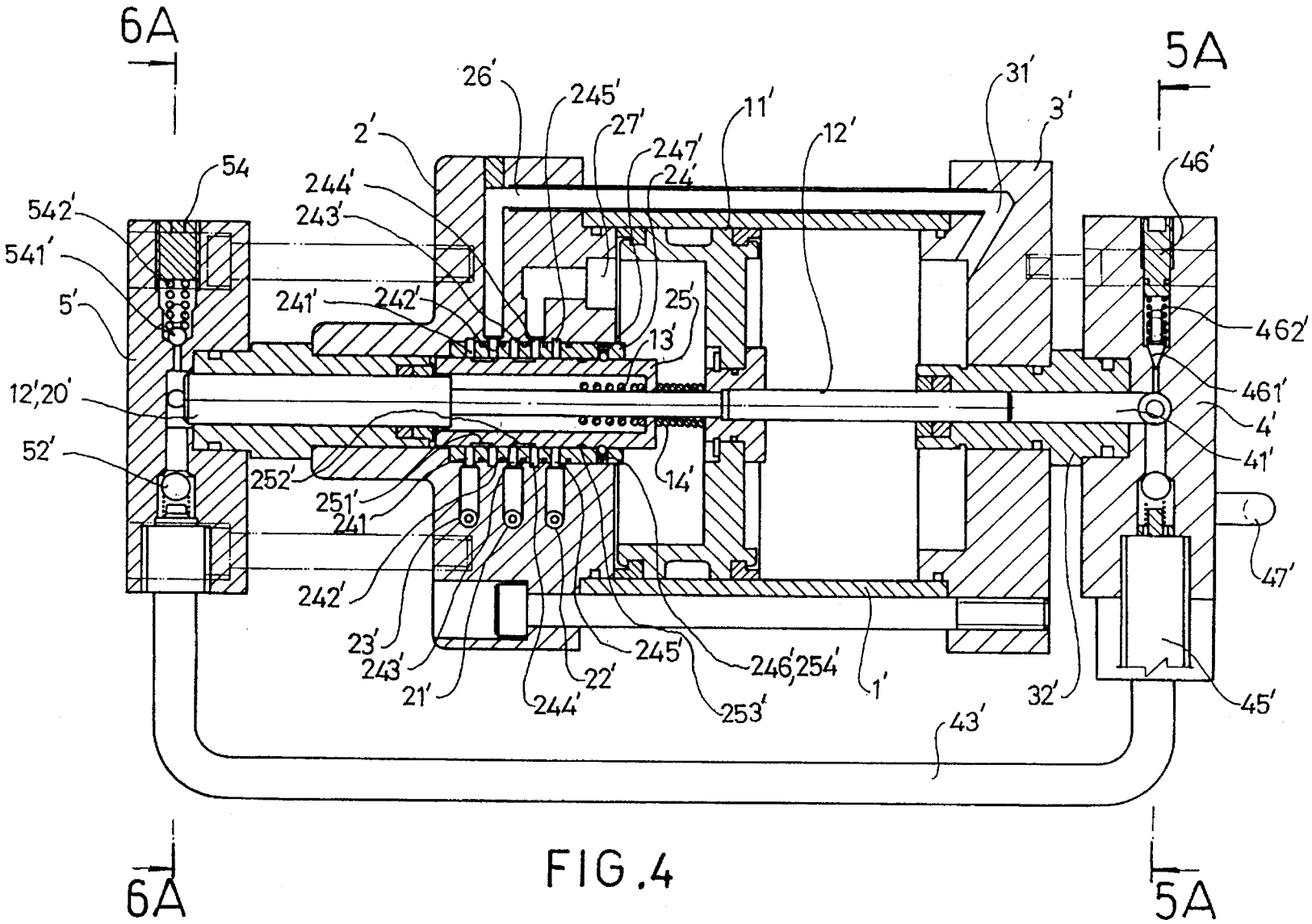
FIG. 4 is a top cross-sectional view of a power cylinder.

FIGS. 3 and 4 illustrate a reversible power cylinder of the invention. The reveresible power cylinder has a cylinder 1', a left cap 2', a right cap 3', a first valve seat 4', a second valve seat 5', and a piston 11'. The left cap 1' covers the left opening of the cylinder 1'. The right cap 2' covers the right opening of the cylinder 1'. A movable sleeve 25' which is disposed in the cylinder 1' is surrounded by a collar 24'. The lead holes 241' to 245' are spacedly formed on the collar 24' to communicate with an air inlet pipe 21' and two air outlet pipes 22' and 23'. Two ring grooves 251' and 252' are formed on the periphery of the movable sleeve 25'. A steel ball 246' and an elastic element 247' are disposed in the recess on the periphery of the collar 24'. A first passage 26' and a second passage 27' are disposed on the left cap 2'. The first passage 26' communicates with the second lead hole 242' and the third passage 31' which is disposed in the right cap 3'. The second passage 27' communicates with the fourth lead hole 244' and the cylinder 1'. The second valve seat 5' and the left cap 2' are connected by a rod 12' which is moved reciprocatedly in the first inner passage 20' of the movable sleeve 25'.

The right cap 3' has third passage 31' to communicate with the first passage 26'. A central hole is formed on the right cap 3' to receive a pump 32'. The pump 32' and the second valve seat 5' are connected by a connection pipe 43'.

The piston 11' is disposed in the cylinder 1'. The air which flows from the second passage 27' forces the piston 11' to move rightward. The air which flows from the third passage 31' forces the piston 11' to move leftward. One portion of the rod 12' is in the inner passage 20'. The first elastic element 13' is disposed inside one end portion of the movable sleeve 25' to press the movable sleeve 25' moving rightward. The second elastic element 14' is disposed between the piston 11' and the movable sleeve 25' to press the movable sleeve 25' moving leftward.

Figure 5:
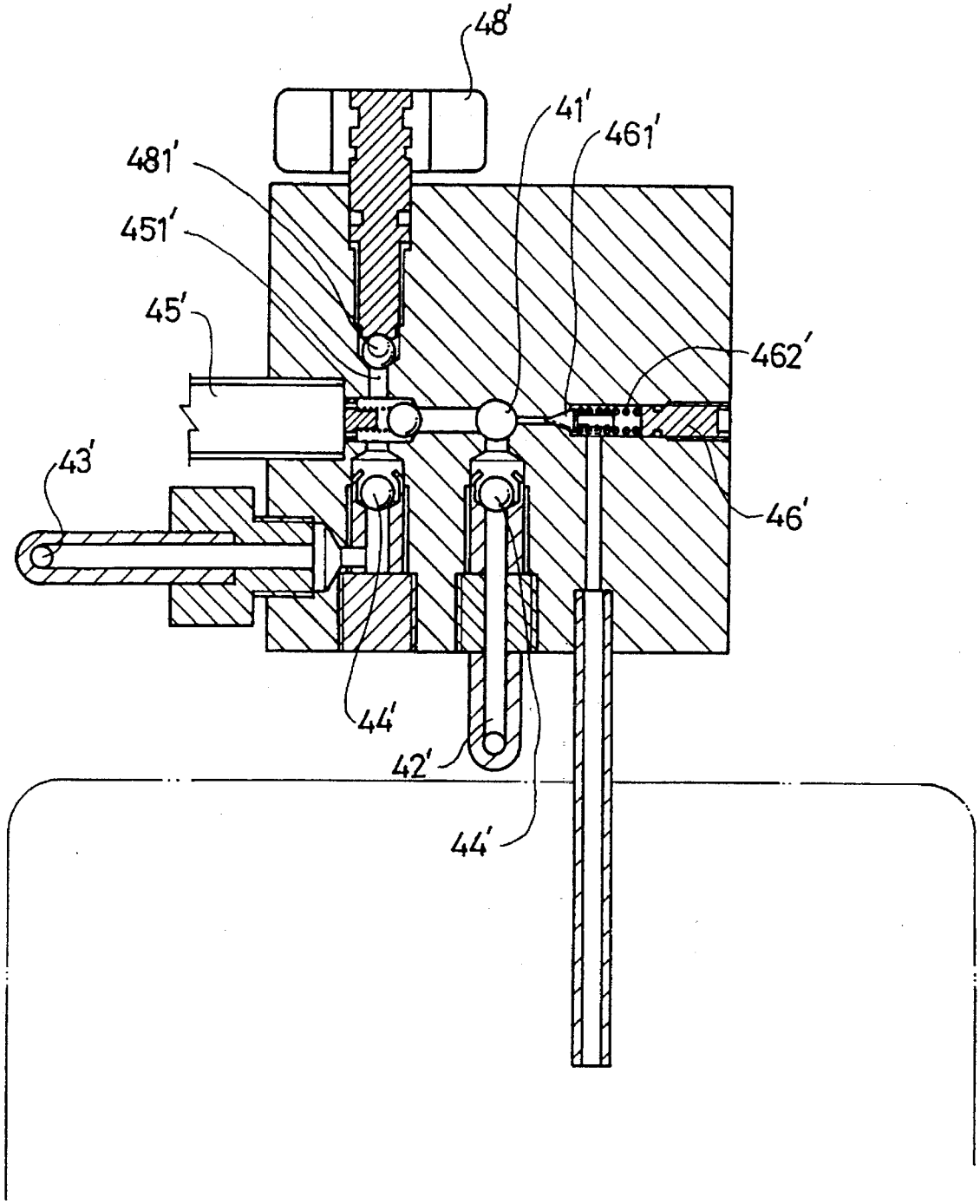
FIG. 5 is a cross-sectional view of a power cylinder taken along line 5A—5A in FIG. 4.

Referring to FIGS. 3 to 5, the first valve seat 4' connects the pump 32'. An oil passage 41' is disposed in the first valve seat 4' and the pump 32'. Two one-way valves 44' (FIG. 5) are disposed near the oil passage 41' to prevent the oil from flowing oppositely. The oil flows from the liquid suction pipe 42' through the oil passage 41' to the pump 32', so the oil pipe 45' can work. When the oil pressure is too high, the adjusting pressure valve 46' can operate to allow oil flowing from the releasing pipe 47' to the oil tank. An elastic element 46' which presses the adjusting pressure valve 46' is rotated by an adjustable button 462' to adjust the pressure. A releasing pressure rod 48' is disposed in the first valve seat 4'. When the releasing pressure rod 48' descends, the steel ball 481' seals the orifice 451'. When the releasing pressure rod 48' ascends, the steel ball 481' does not seal the orifice 451' so that oil can flow from the releasing pipe 47' to the oil tank.

Figure 6:
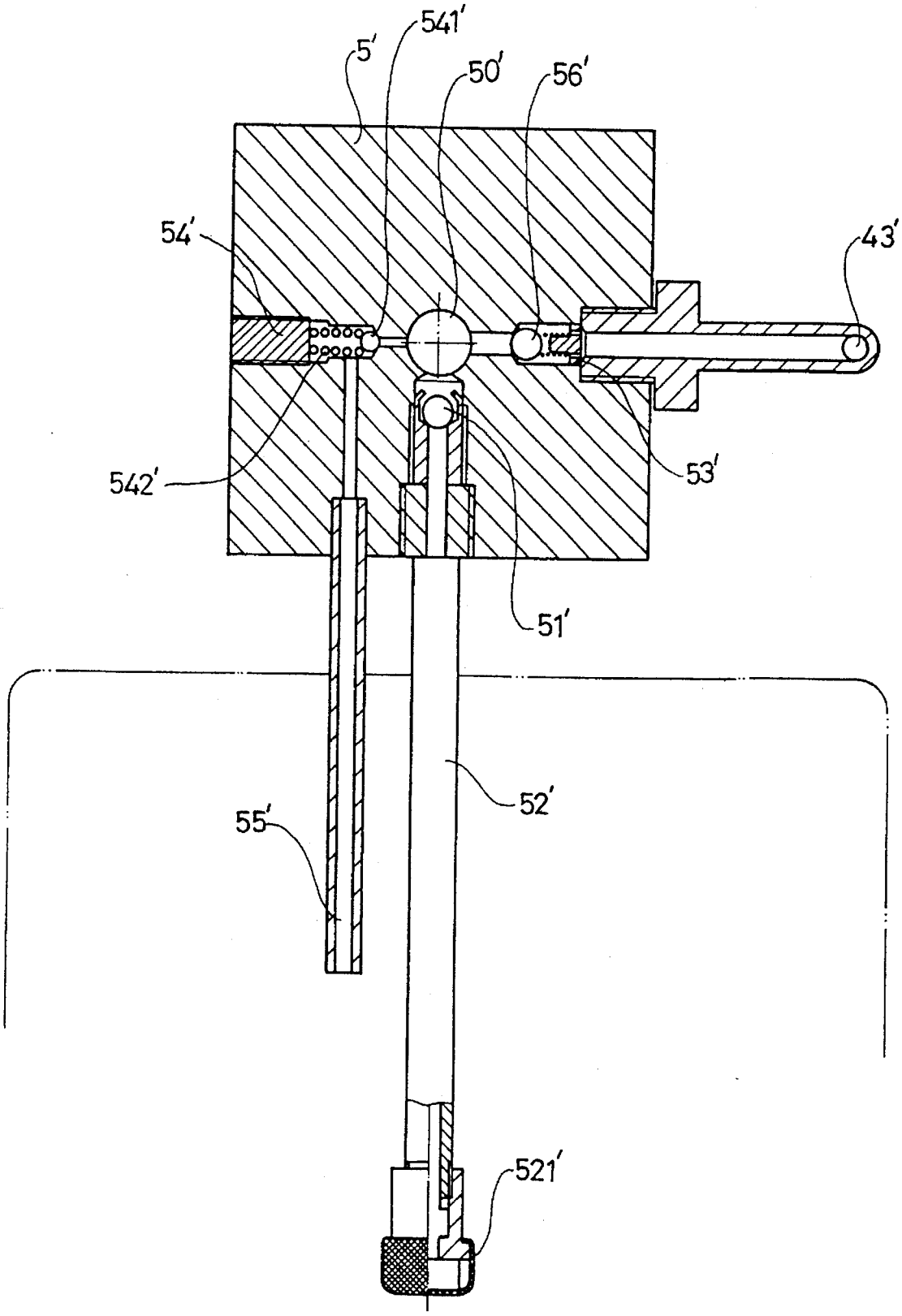
FIG. 6 is a cross-sectional view of a power cylinder taken along line 6A—6A in FIG. 4.

Referring to FIGS. 3, 4 and 6, an opening 50' is formed in the second valve seat 5' to communicate with the first inner passage 20'. When the rod 12' moves rightward, the one-way valve 51' controls the suction of oil of the liquid inlet pipe 52' which communicates with the liquid suction pipe 42' of the first valve seat 4'. A filter layer 521' is disposed in the bottom of the liquid inlet pipe 52'. When the rod 12' moves leftward, the one-way valve 56' controls the flow of oil from an orifice 53' through the connection pipe 43' to the oil pipe 45'. When the oil pressure is too high, the steel ball 541' of the adjustable valve 54' withdraws so that the oil flows from the oil releasing pipe 55' to the oil tank. The steel ball 541' is pressed by the elastic element 542' which is adjusted by an adjustable valve 54' to adjust the pressure of the steel ball 41'.

Figure 7:
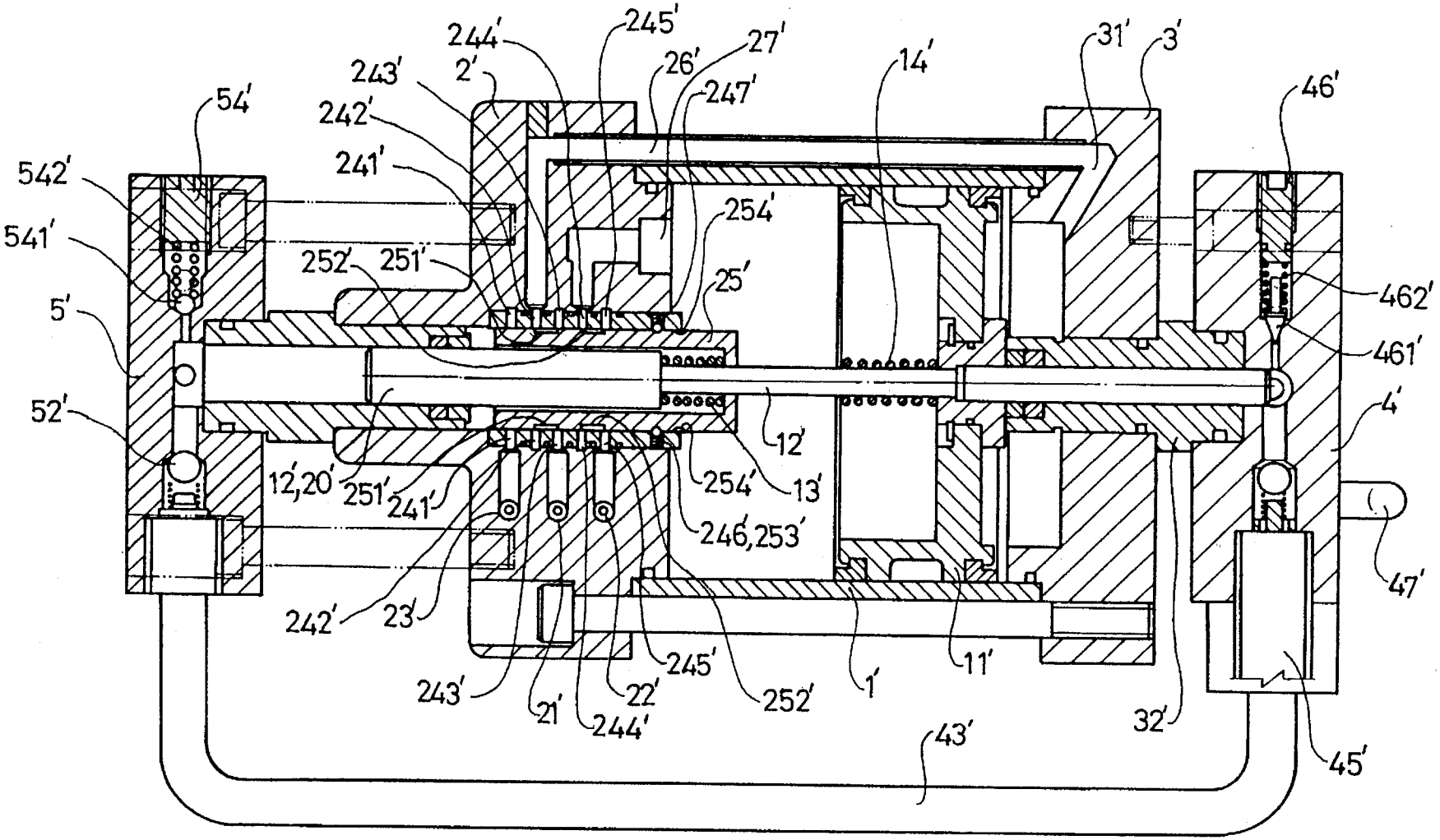
FIG. 7 illustrates a cross-sectional view of a power cylinder in operation.

FIG. 7 illustrates that the diameter of one end portion of the rod 12' is larger than the diameter of the other end portion of the rod 12' so that the pumping of oil can reach the function that the high pressure in one end portion is higher than the low pressure in the other end portion.

Figure 8:
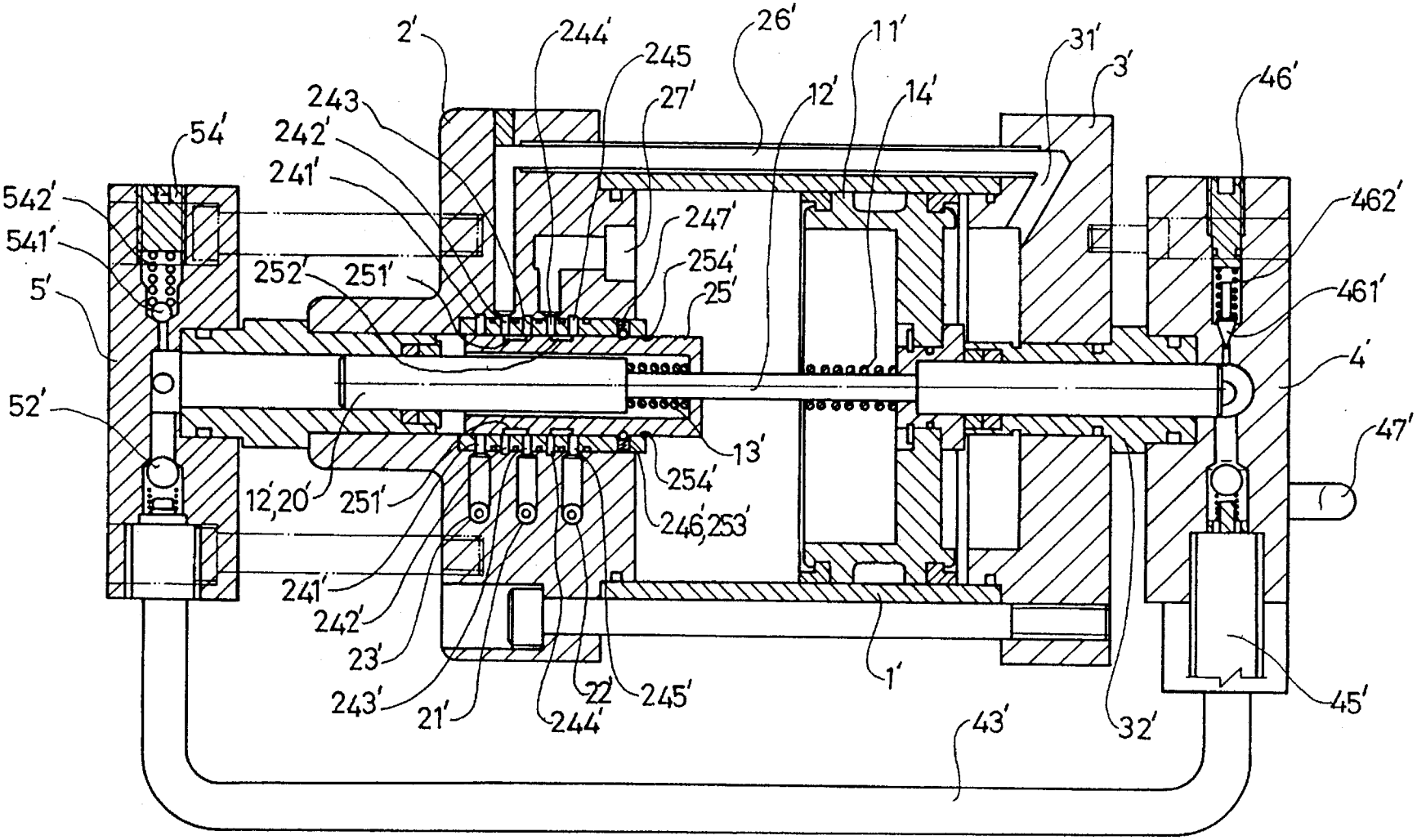
FIG. 8 is a cross-sectional view of a power cylinder similar to FIG. 7 but showing a modification.

FIG. 8 illustrates that the diameter of both end portions of the rod 12" are the same so that the rod 12" can reciprocate very fast to pump liquid quickly.

The invention is not limited to the above embodiment but various modification thereof may be made. It will be understood by those skilled in the art that various changes in form and detail may be made without departing from the spirit and scope of the invention.

What is claimed is:

1. An air pressure pump comprising:

a cylinder, a left cap and a right cap disposed at two sides of said cylinder;

a piston which reciprocates in said cylinder;

an air inlet pipe and first and second air outlet pipes which are connected to said left cap;

a collar having spaced first, second, third, fourth and fifth lead holes, wherein said spaced lead holes communicate with said air inlet pipe and said first and second air outlet pipes;

wherein said collar surrounds a movable sleeve;

first and second ring grooves formed on an end periphery of said movable sleeve;

a first passage and a second passage disposed on said left cap, wherein said first passage communicates with said second lead hole, and said second passage communicates with said fourth lead hole;

an end of said first passage which communicates with said right cap;

an end of said second passage which communicates with said cylinder;

wherein said right cap has a third passage to communicate with said first passage and to provide air into said cylinder;

wherein said right cap has a first central hole to receive a pump which has a second central hole to support a rod;

a valve seat disposed at a bottom of and being connected to said pump;

said rod extending in said movable sleeve and having an end of said rod connected to said piston;

one end of a first elastic element which surrounds an end portion of said rod being restricted by a cover, and the other end of said first elastic element pressing said movable sleeve;

a through hole in said valve seat communicates with said pump;

said through hole communicating with a liquid inlet hole and a liquid outlet hole by a hole which receives said rod;

first and second balls restricting the flow of liquid at said liquid inlet hole and said liquid outlet hole in one direction, respectively.

2. A reversible power cylinder comprising a cylinder, a left cap, a right cap, a first valve seat, a second valve seat, and a piston; said left cap covering a left opening of said cylinder; said right cap covering a right opening of said cylinder; a movable sleeve which is disposed in said cylinder being surrounded by a collar; first, second, third, fourth and fifth lead holes spacedly formed on said collar to communicate with an air inlet pipe and first and second air outlet pipes; first and second ring grooves formed on periphery of said movable sleeve; a steel ball and an elastic element disposed in a recess on a periphery of said collar; a first passage and a second passage disposed on said left cap; said first passage communicating with said second lead hole and a third passage which is disposed in said right cap; said second passage communicating with said fourth lead hole and said cylinder; said second valve seat and said left cap being connected by a rod which is moved reciprocatedly in a first inner passage of said movable sleeve; said third passage to communicate with said first passage; a central hole formed on said right cap to receive a pump; said pump and said second valve seat being connected by a connection pipe; said piston being disposed in said cylinder; a portion of said rod being in said inner passage; a first elastic element being disposed inside an end portion of said movable sleeve; a second elastic element being disposed between said piston and said movable sleeve; said first valve seat connecting said pump; an oil passage being disposed in said first valve seat and said pump; an opening formed in said second valve seat to communicate with said first inner passage; and a filter layer being disposed in a bottom of a liquid inlet pipe.

* * * * *